US006792227B2

(12) United States Patent
Itabashi

(10) Patent No.: US 6,792,227 B2
(45) Date of Patent: Sep. 14, 2004

(54) DEVELOPING AGENT CONTAINER INCLUDING A SEALING ELEMENT FOR PREVENTING DEVELOPING AGENT FROM LEAKING OUT

(75) Inventor: Nao Itabashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/106,240

(22) Filed: Mar. 27, 2002

(65) Prior Publication Data

US 2002/0141778 A1 Oct. 3, 2002

(30) Foreign Application Priority Data

Mar. 27, 2001 (JP) ..... 2001-089060

(51) Int. Cl.[7] ..... G03G 15/08
(52) U.S. Cl. ..... 399/105
(58) Field of Search ..... 399/103, 105, 399/106, 265, 279

(56) References Cited

U.S. PATENT DOCUMENTS 5,212,521 A * 5/1993 Ogawa et al. ..... 399/264
5,488,462 A * 1/1996 Ishikawa et al. ..... 399/103
5,758,230 A * 5/1998 Nakaue et al. ..... 399/103
6,070,027 A * 5/2000 Kawai et al. ..... 399/103
6,321,050 B1 * 11/2001 Sato et al. ..... 399/103

FOREIGN PATENT DOCUMENTS

JP 06308819 A * 11/1994 ..... G03G/15/08
JP 07333988 A * 12/1995 ..... G03G/15/08

* cited by examiner

*Primary Examiner*—Robert Beatty
(74) *Attorney, Agent, or Firm*—Oliff & Berridge, PLC

(57) ABSTRACT

A side seal is doubly provided to prevent toner from leaking outside each end of a housing that accommodates a developing roller in position, with respect to an axial direction of the developing roller. The side seal comprises an inner seal and an outer seal with a specified distance from each other. If toner leaks outside the inner seal, the toner enters a space between the inner seal and the outer seal, so that the toner can be reliably sealed between the developing roller and the outer seal.

16 Claims, 10 Drawing Sheets

DEVELOPING AGENT CONTAINER INCLUDING A SEALING ELEMENT FOR PREVENTING DEVELOPING AGENT FROM LEAKING OUT

BACKGROUND OF THE INVENTION

1. Field of Invention

The invention relates to an electrophotographic image forming apparatus, such as a laser printer.

2. Description of Related Art

Electrophotographic image forming apparatus are well known in the art. These devices, such as a laser printer, typically include a photosensitive drum, a charger, a laser scanner, a developing roller, and a transfer roller. After the surface of the photosensitive drum is uniformly charged by the charger, the surface of the photosensitive drum is irradiated with a laser beam emitted from the laser scanner, and an electrostatic latent image is formed based on predetermined image data.

Toner carried on the developing roller is supplied to the electrostatic latent image formed on the surface of the photosensitive drum. The toner deposited on the surface of the photosensitive drum is transferred to a sheet passing between the photosensitive drum and the transfer roller.

The developing roller is rotatably attached to a developing cartridge. The developing cartridge is provided with sealing elements to prevent toner from leaking from both ends of the developing roller with respect to an axial direction thereof. The sealing elements are placed so as to make sliding contact with the circumferential surface of the developing roller, at both ends of the inside of the developing cartridge with respect to the axial direction of the developing roller when mounted in the developing cartridge in position.

SUMMARY OF THE INVENTION

When a laser printer is used for a prolonged period, toner diffuses toward an axial direction of a developing roller by the rotation of the developing roller, and gradually passes in between the developing roller and a sealing element that makes sliding contact with the developing roller. Before long, toner spreads all over the sealing element, and toner finally leaks.

The invention provides an image forming apparatus to prevent toner leakage when the image forming apparatus is used for a long term and at a high speed.

According to an aspect of the invention, to prevent toner as a developing agent from leaking from a housing of a developing cartridge, the developing cartridge as a developing agent container is provided with a sealing element. The sealing element is disposed so as to make contact with a circumferential surface of the developing roller at an end. The sealing element has a first surface and a second surface. The second surface is disposed outwardly of the first surface in the axial direction of the developing roller at a specified distance from the first surface to provide a space therebetween. To provide the spacing, a plurality of sealing elements may be disposed with a specified distance from each other at one end.

Toner that passed in between the developing roller and the first surface spreads all over the first surface as the use of the laser printer prolongs, and as a result, toner may leak from the first surface. According to another aspect of the invention, leaking toner drops in the space provided between the first surface and the second surface, but does not move in between the developing roller and the second surface. Thus, even when the laser printer is used for a long term or at a high speed for continuous image forming, toner does not leak outside the housing.

Toner is prone to pass in between the developing roller and the sealing element because the developing roller rotates. However, toner does not leak outside with a structure indicated in another aspect of the invention.

When sealing elements are provided at both ends of the developing roller with respect to the axial direction thereof, toner can be sealed at both ends where toner is prone to leak, thereby improving the toner sealability.

Preferably, the developing roller is made of an elastic member to reduce damage to a photosensitive member and toner. The developing roller made of an elastic member has difficulty carrying toner on the surface, and is apt to cause toner leakage, as compared with that of a foam member. If the developing roller is made of metal, it is also apt to cause toner leakage because the surface is easily scratched. However, with the adoption of the sealing element, toner leakage can be reliably prevented even when the developing roller is made of an elastic member, especially silicone rubber.

The first surface and the second surface make sliding contact with the circumferential surface of the developing roller, to prevent toner leakage. Further, the sealing element is made of felt, thereby reducing frictional resistance between the developing roller and the sealing element.

If the sealing element is made of a foam member such as a sponge, it may be torn due to the sliding contact with the developing roller. If the sealing element is made of an elastic member, which is not a foam member, resistance in the sliding contact becomes great, and great loads are imposed on the developing roller and the sealing element. Under this condition, when toner passes in between the developing roller and the sealing element, the toner scratches the surface of the sealing element from which toner is prone to leak.

Felt is preferably made from polyester-base fibers. Polyester-base fibers are excellent in wear resistance and durability, thus, the sealing element resists damage during continuous use, so that toner leakage can be reliably prevented.

It is preferable that a thickness of each of the fibers for felt is smaller than or equal to 2.1 times as large as a mean particle diameter of toner. Such fine fibers resist damage and reliably absorb toner because they are tangled closely, thereby reliably preventing toner leakage.

The first surface and the second surface are coated with a fluorine-base lubricating agent including a fluorine oil and fluorine-base resin. The lubricating agent works between the developing roller and the sealing element, reducing resistance to the sliding contact. Thus, the wear resistance and the durability of the sealing element are improved and noise due to the sliding contact are prevented from generating. Especially, as the fluorine-base lubricating agent includes fluorine oil and fluorine-base resin, it greatly contributes to an effect of reducing the frictional resistance.

As toner, prepared polymerized toner may be used. Polymerized toner has a uniform particle size of 5–10 $\mu$m, is excellent in the flowability, and suitable to form high quality images. Polymerized toner tends to pass in between the developing roller and the sealing element, becoming a cause of toner leakage. However, with the structure of the invention, toner leakage can be reliably prevented.

To assemble the above developing cartridge, the sealing elements are placed inside the housing, the developing roller is placed, from a direction parallel to the direction that the developing roller feeds toner, on the first surface and the second surface, and bearings are mounted at both ends of the developing roller from outside the housing.

If the developing roller is placed, from a direction parallel to the axial direction of the developing roller, on the first surface and the second surface, the circumferential surface of the developing roller, the first surface, and the second surface are rubbed in the axial direction of the developing roller. To avoid increasing the size of the developing cartridge, the first surface and the second surface should be made narrow. In this case, they are weak in rigidity, and liable to deform. The deformation of the sealing element causes toner leakage.

However, in the assembling method, the developing roller is placed on the first surface and the second surface from the direction parallel to the direction that the developing roller feeds toner, and thus, the first surface and the second surface do not receive a force causing these surfaces to be deformed. As a result, there is little likelihood of toner leakage due to the deformation of the sealing elements.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
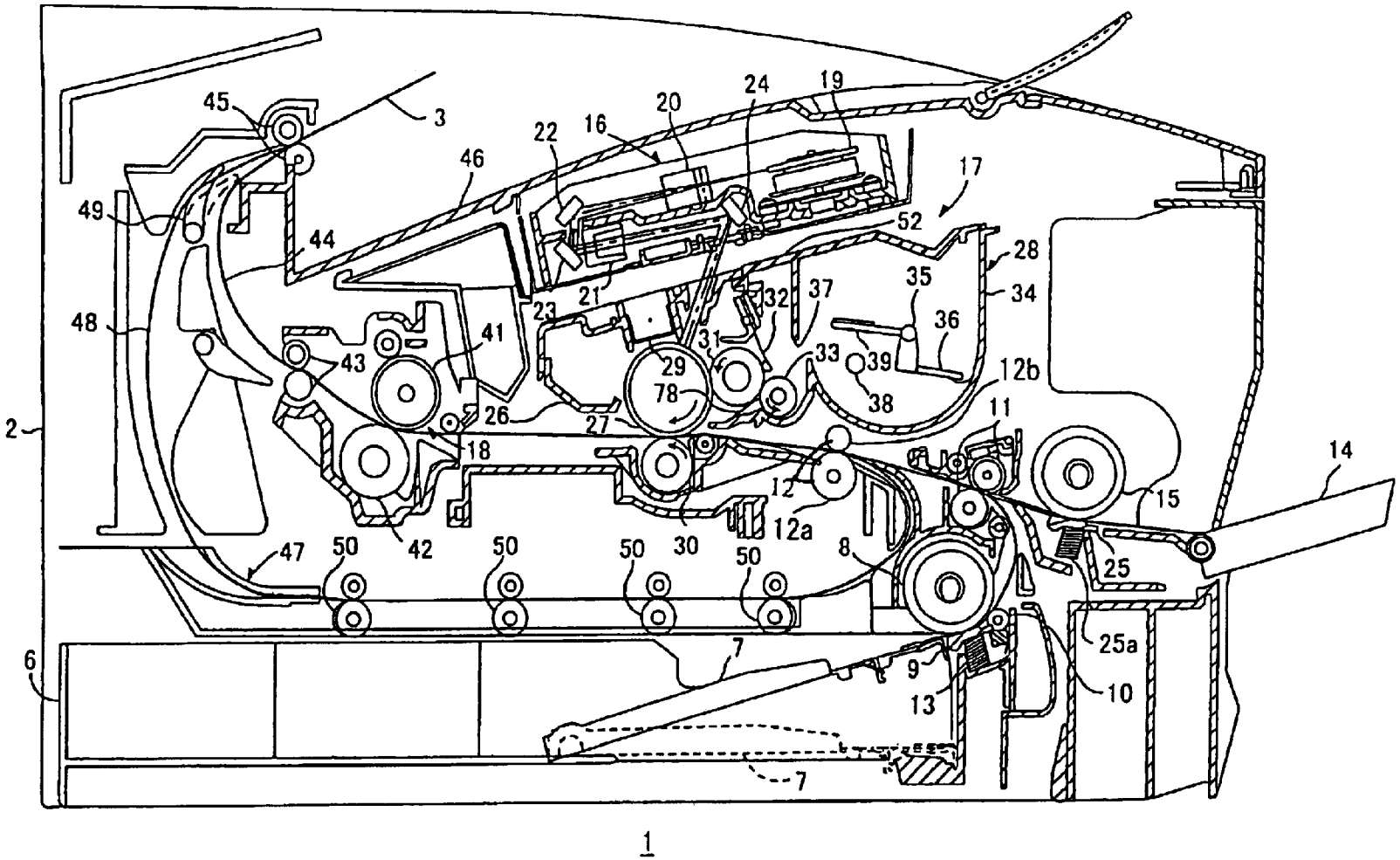
FIG. 1 is a side sectional view of the substantial parts of a laser printer according to one embodiment of the invention.

FIG. 1 is a side sectional view of the substantial parts of a laser printer 1 according to an embodiment of the invention. A sheet feed tray 6 is detachably attached to a bottom portion of a casing 2. A presser plate 7 is provided in the sheet feed tray 6 so as to support and upwardly press sheets 3 stacked in the sheet feed tray 6. A sheet feed roller 8 and a sheet feed pad 9 are provided above one end of the sheet feed tray 6, and register rollers 12 are provided downstream from the sheet feed roller 8 with respect to the sheet conveying direction.

The presser plate 7 allows sheets 3 to be stacked thereon. The presser plate 7 is pivotally supported at its end remote from the sheet feed roller 8 such that the presser plate 7 is vertically movable at its end closer to the sheet feed roller 8. The presser plate 7 is urged upwardly from its reverse side by a spring (not shown). When the stack of sheets 3 is increased in quantity, the presser plate 7 swings downwardly about the end of the presser plate 7 remote from the sheet feed roller 8, against the urging force from the spring. The sheet feed roller 8 and the sheet feed pad 9 are disposed facing each other. The sheet feed pad 9 is urged toward the sheet feed roller 8 by a spring 13 disposed on the reverse side of the sheet feed pad 9.

An uppermost sheet 3 in the stack on the presser plate 7 is pressed against the sheet feed roller 8 by the spring provided on the reverse side of the presser plate 7, and the uppermost sheet 3 is pinched between the sheet feed roller 8 and the sheet feed pad 9 when the sheet feed roller 8 rotates. Thus, print sheets 3 are fed one by one from the top.

After paper dust is removed from the sheet 3 by a paper dust removing roller 10, the sheet 3 is conveyed by conveyer rollers 11 to the resister rollers 12. The register rollers 12 are made up of two rollers, that is, a driving roller 12*a* provided for the casing 2 and a driven roller 12*b* provided for a process unit 17, which will be described later. The driving roller 12*a* and the driven roller 12*b* make a surface-to-surface contact with each other. The sheet 3 conveyed by the conveyor rollers 11 is further conveyed downstream while being pinched between the driving roller 12*a* and the driven roller 12*b*.

The driving roller 12*a* is not driven before the sheet 3 makes contact with the driving roller 12*a*. After the sheet 3 makes contact with the driving roller 12*a* and the driving roller 12*a* corrects the orientation of the sheet 3, the driving roller 12*a* rotates and conveys the sheet 3 downstream.

A manual feed tray 14 from which sheets 3 are manually fed and a manual feed roller 15 that feeds sheets 3 stacked on the manual feed tray 14 are provided at the front of the casing 2. A separation pad 25 is disposed facing the manual feed roller 15. The separation pad 25 is urged toward the manual feed roller 15 by a spring 25*a* disposed on the reverse side of the separation pad 25. The sheets 3 stacked on the manual feed tray 14 are fed one by one while being pinched by the manual feed roller 15 and the separation pad 25 when the manual feed roller 15 rotates.

The casing 2 further includes a scanner unit 16, a process unit 17, and a fixing unit 18.

The scanner unit 16 is provided in an upper portion of the casing 2 and has a laser emitting portion (not shown), a rotatable polygonal mirror 19, lenses 20, 21, and reflecting mirrors 22, 23, 24. A laser beam emitted from the laser emitting portion is modulated based on predetermined image data. The laser beam sequentially passes through or reflects from the optical elements, that is, the polygonal mirror 19, the lens 20, the reflecting mirrors 22, 23, the lens 21, and the reflecting mirror 24 in the order indicated by a broken line in FIG. 1. The laser beam is thus directed to and scanned at a high speed over the surface of a photosensitive drum 27, which will be described later.

Figure 2:
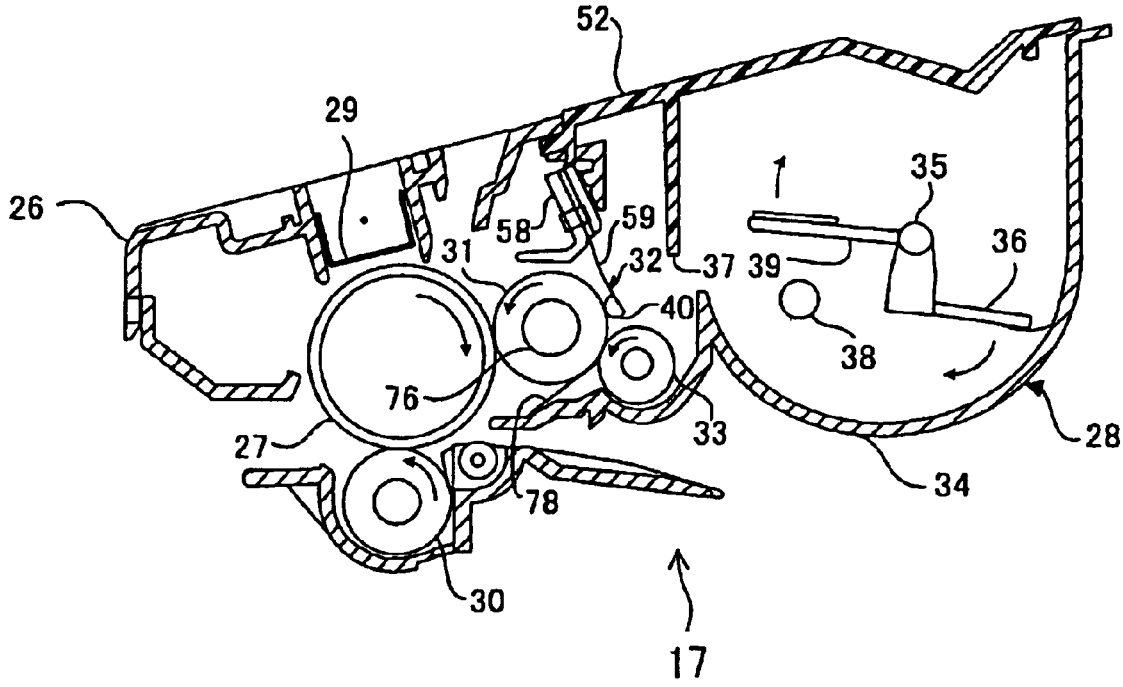
FIG. 2 is a side sectional view of the substantial parts of a process unit of the laser printer shown in FIG. 1.

FIG. 2 is an enlarged sectional view of the process unit 17. As shown in FIG. 2, the process unit 17 is disposed below the scanner unit 16 and has a drum cartridge 26 detachably attached to the casing 2 and a developing cartridge 28 detachably attached to the drum cartridge 26. The drum cartridge 26 includes the photosensitive drum 27, a scorotron charger 29, a transfer roller 30, and an electrically conductive brush 51.

The developing cartridge 28 includes a developing roller 31, a layer thickness-regulating blade 32, a supply roller 33, a developing chamber 34*a*, and a toner box 34*b*.

The toner box 34*b* contains positively charged nonmagnetic single-component toner, as a developing agent. The toner used in this embodiment is a polymerized toner obtained through copolymerization of styrene-based monomers, such as styrene, and acryl-based monomers, such as acrylic acid, alkyl (C1–C4) acrylate, alkyl (C1–C4) methacrylate, using a known polymerization method, such as suspension polymerization. The particle shape of such a polymerized toner is spherical, and thus the polymerized toner has excellent flowability.

A coloring agent, such as carbon black, and wax is added to the polymerized toner. An external additive, such as silica, is also added to the polymerized toner to improve flowability. The particle size of the polymerized toner is approximately 6–10 $\mu$m.

The toner in the toner box 34*b* is stirred by an agitator 36 supported by a rotating shaft 35 provided at a central portion of the toner box 34*b*, and is discharged from a toner supply port 37 opened on one side of the toner box 34*b*, toward the developing chamber 34*a*. A toner detection window 38 is provided on a side wall of the toner box 34*b*. The toner detection window 38 is wiped clean by a cleaner 39 supported by the rotating shaft 35.

A supply roller 33 is rotatably disposed in the developing chamber 34*a*. A developing roller 31 is rotatably disposed facing the supply roller 33.

The supply roller 33 is formed by covering a metallic roller shaft with an electrically conductive foam material. The developing roller 31 is formed by covering a metallic roller shaft with an electrically conductive rubber material. More specifically, the developing roller 31 is covered with an electrically conductive urethane or silicone rubber containing fine carbon particles, and coated with a urethane or silicone rubber containing fluorine. The supply roller 33 and the developing roller 31 are disposed in contact with each other so that they are press-deformed against each other to an appropriate extent. A predetermined developing bias is applied to the developing roller 31 with respect to the photosensitive drum 27.

A layer thickness-regulating blade 32 is disposed near the developing roller 31 to regulate the thickness of a toner layer formed on the surface of the developing roller 31. The layer thickness-regulating blade 32 has a metallic plate spring and a presser portion 40, which is disposed on a distal end of the plate spring and formed from an electrically insulative silicone rubber into a semicircular shape in section. The plate spring is supported, at its end opposite to its distal end, by a developing cartridge 28 so as to be close to the developing roller 31. The presser portion 40 is pressed against the developing roller 31 by an elastic force of the plate spring.

Toner discharged by the agitator 36 from the toner supply port 37 to the developing chamber 34*a* is supplied to the developing roller 31 when the supply roller 33 rotates. Toner is positively charged between the supply roller 33 and the developing roller 31 due to friction. Toner supplied to the developing roller 31 passes between the presser portion 40 and the developing roller 31 and is sufficiently positively charged therebetween due to friction. After passing between the presser portion 40 and the developing roller 31, toner is formed into a thin layer of a predetermined thickness on the developing roller 31.

The photosensitive drum 27 is rotatably disposed adjacent to a drum cartridge 26 so as to be in contact with the developing roller 31. The photosensitive drum 27 is formed by coating a grounded cylindrical aluminum drum with a positively charged photosensitive layer made of polycarbonate.

The scorotron charger 29 is disposed at a predetermined interval upward from the photosensitive drum 27. The scorotron charger 29 is a charger that produces corona discharge from a tungsten wire and positively charges the surface of the photosensitive drum 27 uniformly.

The transfer roller 30 is disposed below the photosensitive drum 27 and is rotatably supported by the drum cartridge 26 so as to face the photosensitive drum 27. The transfer roller 30 is formed by covering a metallic roller shaft with an electrically conductive rubber material. A power source (not shown) is connected to the roller shaft, and a predetermined transfer bias is applied to the roller shaft when toner on the photosensitive drum 27 is transferred to the sheet 3.

As shown in FIG. 1, the fixing unit 18 is disposed downstream from the process unit 17 and has a heat roller 41, a pressure roller 42 pressed against the heat roller 41, and a pair of conveying rollers 43 provided downstream from the heat roller 41 and the pressure roller 42. The heat roller 41 is formed by an aluminum tube coated with a silicone rubber and a halogen lamp placed in the tube. Heat generated from the halogen lamp is transferred to the sheet 3 through the aluminum tube. The pressure roller 42 is made of a silicone rubber, which allows the sheet 3 to be easily removed from the heat roller 41 and the pressure roller 42.

The toner transferred to the sheet 3 by the process unit 17 melts and becomes fixed onto the sheet 3 due to heat, while the sheet 3 is passing between the heat roller 41 and the pressure roller 42. After the fixation is completed, the sheet 3 is conveyed downstream by the conveying rollers 43.

An ejecting path 44 is formed downstream from the conveying rollers 43 to reverse the sheet conveying direction and guide the sheet 3 to an output tray 46 provided on the top surface of the laser printer 1. A pair of ejecting rollers 45 are provided at the upper end of the ejecting path 44 to eject the sheet 3 to the output tray 46.

The laser printer 1 is provided with a reverse conveying unit 47 that allows image forming on the both sides of the sheet 3. The reverse conveying unit 47 includes ejecting rollers 45, a reverse conveying path 48, a flapper 49, and a plurality of pairs of reverse conveying rollers 50.

A pair of ejecting rollers 45 can be switched between forward and reverse rotation. The ejecting rollers 45 rotate forward to eject the sheet 3 to the output tray 46, and rotate in reverse to reverse the sheet conveying direction.

The reverse conveying path 48 is vertically provided to guide the sheet 3 from the ejecting rollers 45 to the reverse conveying rollers 50 disposed above the sheet feed tray 6. The upstream end of the reverse conveying path 48 is located near the ejecting rollers 45, and the downstream end of the reverse conveying path 48 is located near the reverse conveying rollers 50.

The flapper 49 is swingably provided adjacent to a point branching into the ejecting path 44 and the reverse conveying path 48. The flapper 49 can be shifted between a first position shown by a solid line and a second position shown by a broken line. The flapper 49 is shifted by switching the excited state of a solenoid (not shown).

When the flapper 49 is at the first position, the sheet 3 guided along the ejecting path 44 is ejected by the ejecting rollers 45 to the output tray 46. When the flapper 49 is at the second position, the sheet 3 is conveyed to the reverse conveying path 48 by the ejecting rollers 45 rotating in reverse.

A plurality of pairs of reverse conveying rollers 50 are provided above the sheet feed tray 6 in a horizontal direction. A pair of reverse conveying rollers 50 on the most upstream side are located near the lower end of the reverse conveying path 48. A pair of reverse conveying rollers 50 on the most downstream side are located below the register rollers 12.

The operation of the reverse conveying unit 47 when an image is formed on the both sides of the sheet 3 will be described. The sheet 3 with a printed image on one side thereof is conveyed by the conveying rollers 43 along the ejecting path 44 toward the ejecting rollers 45. At this time, the flapper 49 is located at the first position. The ejecting rollers 45 rotate forward while pinching the sheet 3 to convey the sheet 3 temporarily toward the output tray 46. The ejecting rollers 45 stop rotating forward when the sheet 3 is almost ejected to the output tray 46 and the trailing edge of the sheet 3 is pinched by the ejecting rollers 45. In this state, the flapper 49 is shifted to the second position, and the ejecting rollers 45 rotate in reverse. The sheet 3 is conveyed in the reverse direction along the reverse conveying path 48. After the entire sheet 3 is conveyed to the reverse conveying path 48, the flapper 49 is shifted to the first position.

After the above actions have occurred, the sheet 3 is conveyed to the reverse conveying rollers 50, and conveyed upward by the reverse conveying rollers 50 to the register rollers 12. The sheet 3 is then conveyed to the process unit 17 with its printed side facing down. As a result, an image is printed on both sides of the sheet 3.

The image forming operation will now be described. The surface of the photosensitive drum 27 is uniformly positively charged by the scorotron charger 29. The surface potential of the photosensitive drum 27 is approximately 900 V. When the surface of the photosensitive drum 27 is irradiated with a laser beam emitted from the scanner unit 16, electric charge is removed from a portion exposed to the laser beam, and the surface potential of the exposed portion becomes approximately 200 V. In this way, the surface of the photosensitive drum 27 is divided into a high-potential portion (unexposed portion) and a low-potential portion (exposed portion), and thereby an electrostatic latent image is formed.

The surface potential of the unexposed portion is approximately 900 V, while the surface potential of the exposed portion is approximately 200 V.

When positively charged toner on the developing roller 31 faces the photosensitive drum 27, the toner is supplied to the low-potential exposed portion of the photosensitive drum 27. As a result, an electric latent image formed on the photosensitive drum 27 is visualized.

The developing roller 31 reclaims the toner remaining on the surface of the photosensitive drum 27. The remaining toner is the toner that has been supplied to the photosensitive drum 27 but not transferred by the transfer roller 30 from the photosensitive drum 27 to the sheet 3. The remaining toner adheres to the developing roller 31 by a Coulomb force generated due to a potential difference between the photosensitive drum 27 and the developing roller 31, and is reclaimed into the developing cartridge 28. With this method, a scraper that scrapes the remaining toner from the photosensitive drum 27 and a storage place for the scraped toner are not required. Thus, a laser printer can be simplified in structure and made compact, and the manufacturing cost thereof can be reduced.

While the sheet 3 is passing between the photosensitive drum 27 and the transfer roller 30, the toner forming a visualized image on the photosensitive drum 27 is transferred to the sheet 3 by a Coulomb force generated due to a potential difference between the potential of the sheet 3 and the surface potential of the photosensitive drum 27.

The sheet 3 is conveyed to the fixing unit 18, and as described above, the toner on the sheet 3 melts and becomes fixed onto the sheet 3 due to heat. After passing along the ejecting path 44, the sheet 3 where the toner is fixed is ejected to the output tray 46.

Side seals 51 are disposed at both ends of the inside of the developing cartridge 28 with respect to an axial direction of the developing roller 31 when mounted in position in the developing cartridge 28 in order to prevent toner carried on the developing roller 31 from leaking from both ends of the developing roller 31. Referring to FIGS. 4A to 6, the sealing structure at each end of the inside of the developing cartridge 28 with respect to the axial direction of the developing roller 31 will be described. The figures show structural elements at only one end of the inside of the developing cartridge 28, and the following descriptions are made based on one end of the inside of the developing cartridge 28. The structural elements at the one end are identical to those at the other end.

Figure 4A:
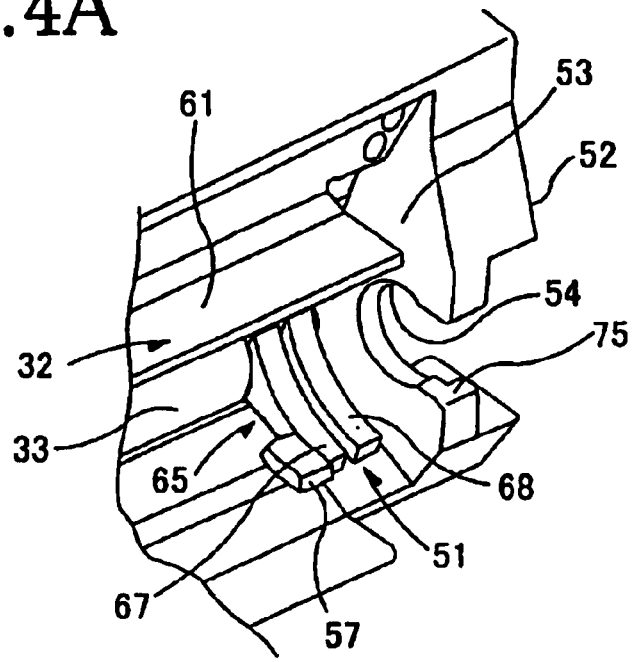
FIG. 4A is a perspective view of the substantial parts of a sealing structure at an end of the developing cartridge with respect to an axial direction of the developing roller to be mounted in the developing cartridge, where a sponge seal of a side seal is affixed.

As shown in FIG. 4A, a housing 52 constituting the developing cartridge 28 is open at a front side. A side wall 53 of the housing 52 is provided with a support hole 54 for which the developing roller 31 is mounted in the housing 52. Adjacent to the side wall 53, the side seal 51, an upper side seal 55 (FIG. 5), a blade side seal 56 (FIG. 5), and a lower side seal 57 are provided, which reliably prevent toner from leaking from each end of the developing roller 31 when mounted in the developing cartridge 28 in position. The support hole 54 has an opening 75 at a front side thereof and is formed so as to receive the roller shaft 76 of the developing roller 31 along the opening 75.

Figure 5:
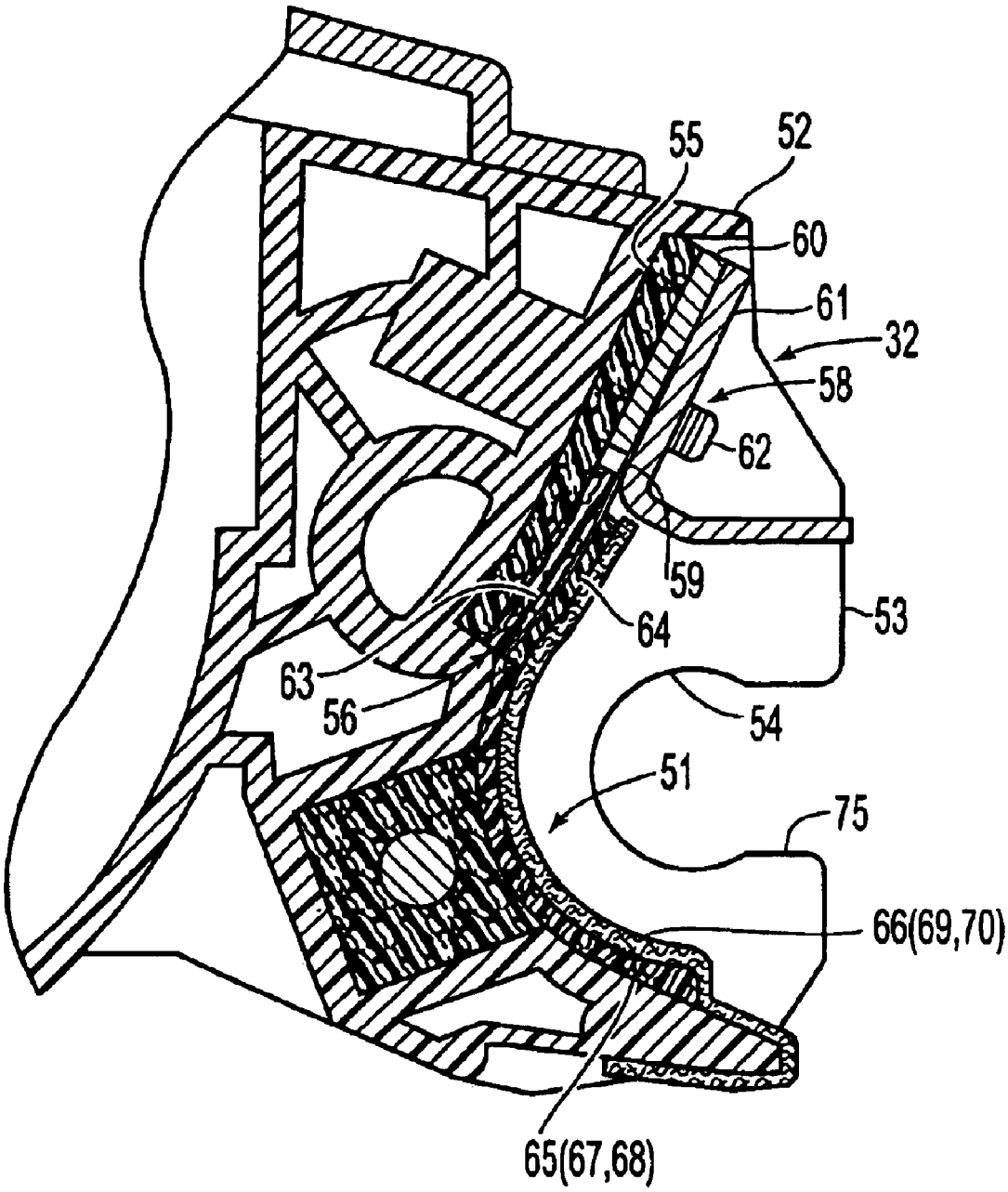
FIG. 5 is a side sectional view of the substantial parts of the sealing structure at the end of the developing cartridge shown in FIG. 4B, when the developing roller is not mounted.

The upper side seal 55 is made of a spongy material (e.g. urethane) formed in a substantially rectangular shape having a fixed thickness. As shown in FIG. 5, the upper side seal 55 is disposed facing a leaf spring member 59 of the layer thickness-regulating blade 32 at an upper portion of the end of the housing 52, and affixed to the housing 52 with double-faced adhesive tape. Provision of the upper side seal 55 can improve the adhesion of the blade side seal 56.

The blade side seal 56 is provided facing the upper side seal 55 at an end of the leaf spring member 59 of the layer thickness-regulating blade 32. The blade side seal 56 is made up of a back blade seal 63 provided on a rear surface of the leaf spring member 59 and a front blade seal 64 provided on a front surface of the leaf spring member 59.

A support member 58 of the layer thickness-regulating blade 32 is comprised of a back support member 60 formed in a plate extending along the axial direction of the developing roller 31, and a front support member 61, which is an L-shape in cross section and is in face-to-face relation with the back support member 60. With the leaf spring member 59 sandwiched between the back support member 60 and the front support member 61, the support member 58 is secured to an upper part of the housing 52 using two screws 62.

The back blade seal 63 is made of a sponge material (e.g. urethane) formed in a substantially rectangular shape having a fixed thickness. The back blade seal 63 is affixed to the rear surface of the leaf spring member 59 facing the upper side seal 55, with double-faced adhesive tape. The back blade seal 63 and the upper side seal 55 are made of sponge material and make contact with each other, thereby preventing the toner from leaking from the upper part of each end of developing roller 31 when mounted in position.

The front blade seal 64 is made of a sponge material (e.g. urethane) formed in a substantially rectangular shape having a fixed thickness, and is affixed to the leaf spring member 59 facing the back blade seal 63 with double-faced adhesive tape. A felt sealing element 66 is placed over the front blade seal 64. When the front blade seal 64 and the felt sealing element 66 are layered, they are compressed to an extent that a total thickness of them becomes thicker than the thickness of the presser portion 40 of the layer thickness-regulating blade 32. With this structure, toner can be prevented from laterally leaking from between the presser portion 40 and the developing roller 31, even if the presser portion 40 is worn by friction with the developing roller 31.

Figure 4B:
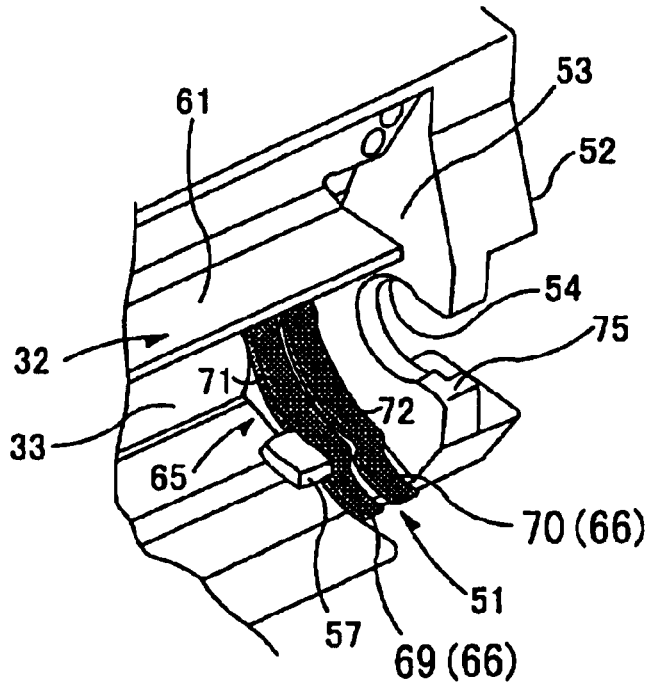
FIG. 4B is a perspective view of the substantial parts of the sealing structure at the end of the developing cartridge, where a felt sealing element is overlaid on the sponge seal.

As shown in FIGS. 4A, 4B, the lower side seal 57 is made of a sponge material (e.g. urethane) formed in a substantially rectangular shape having a fixed thickness, disposed adjacent to an inner side of the side seal 51, and affixed to a lower part of the housing 52 with double-faced adhesive tape.

Figure 3:
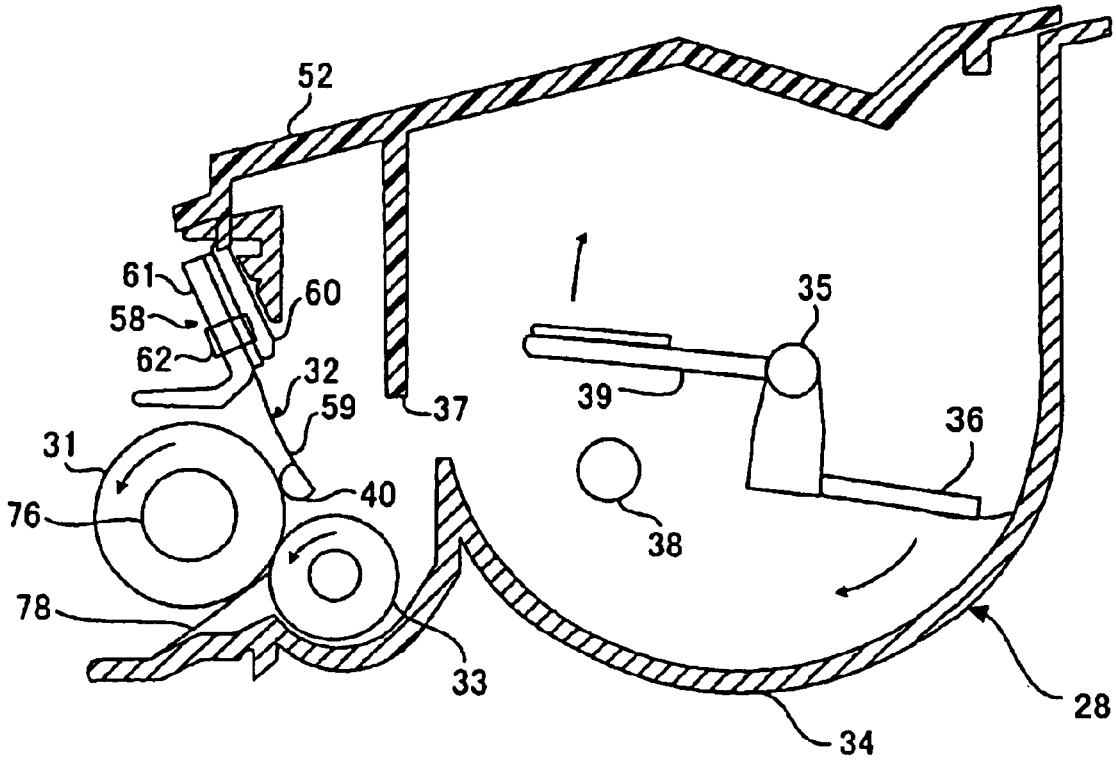
FIG. 3 is a side sectional view of the substantial parts of a developing cartridge in the process unit shown in FIG. 2.

Provision of the lower side seal 57 can prevent the toner from leaking from a boundary between the side seal 51 and a lower film 78 (FIG. 3).

The side seal 51 is provided adjacent to the side wall 53 of the housing 52 so as to make sliding contact with a circumferential surface of the developing roller 31. The side seal 51 is comprised of a sponge seal 65, and a felt sealing element 66 which is overlaid on the sponge seal 65.

Figure 7:
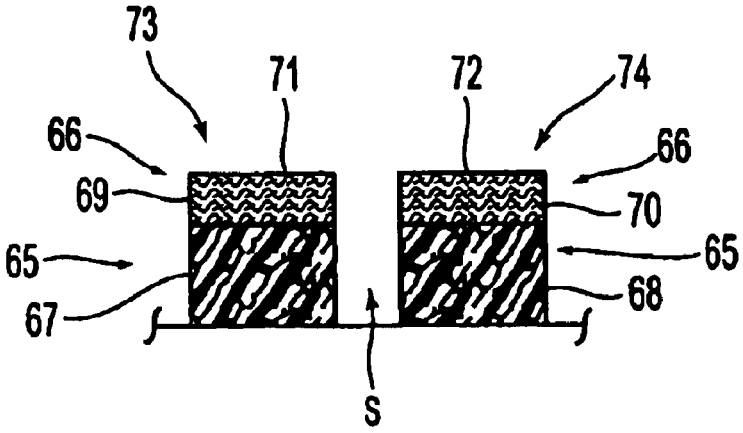
FIG. 7 is a sectional view of the substantial parts of the side seal shown in FIG. 4B.

The sponge seal 65, providing an urging force, is comprised of a sponge inner 67 and a sponge outer 68. As shown in FIGS. 4A and 7, the sponge inner 67 is disposed on an inner side with respect to the axial direction of the developing roller 31 when mounted in the housing 52 in position, and the sponge outer 68 is disposed on an outer side at a specified distance from the sponge inner 67.

The sponge inner 67 and the sponge outer 68 are made of a spongy material such as urethane. More specifically, they are made of urethane having a comparatively high rigidity (trademark: Poron, manufactured by Rogers Inoac Corporation), and formed in a substantially rectangular shape having a certain thickness to generate a fixed pressing force when compressed by the developing roller 31 mounted in position.

As shown in FIG. 4A, the sponge inner 67 and the sponge outer 68 are affixed inside the housing 52 adjacently to the side wall 53 with double-faced adhesive tape, so as to extend in a direction perpendicular to the axial direction of the developing roller 31, at a specified distance from each other.

Figure 6:
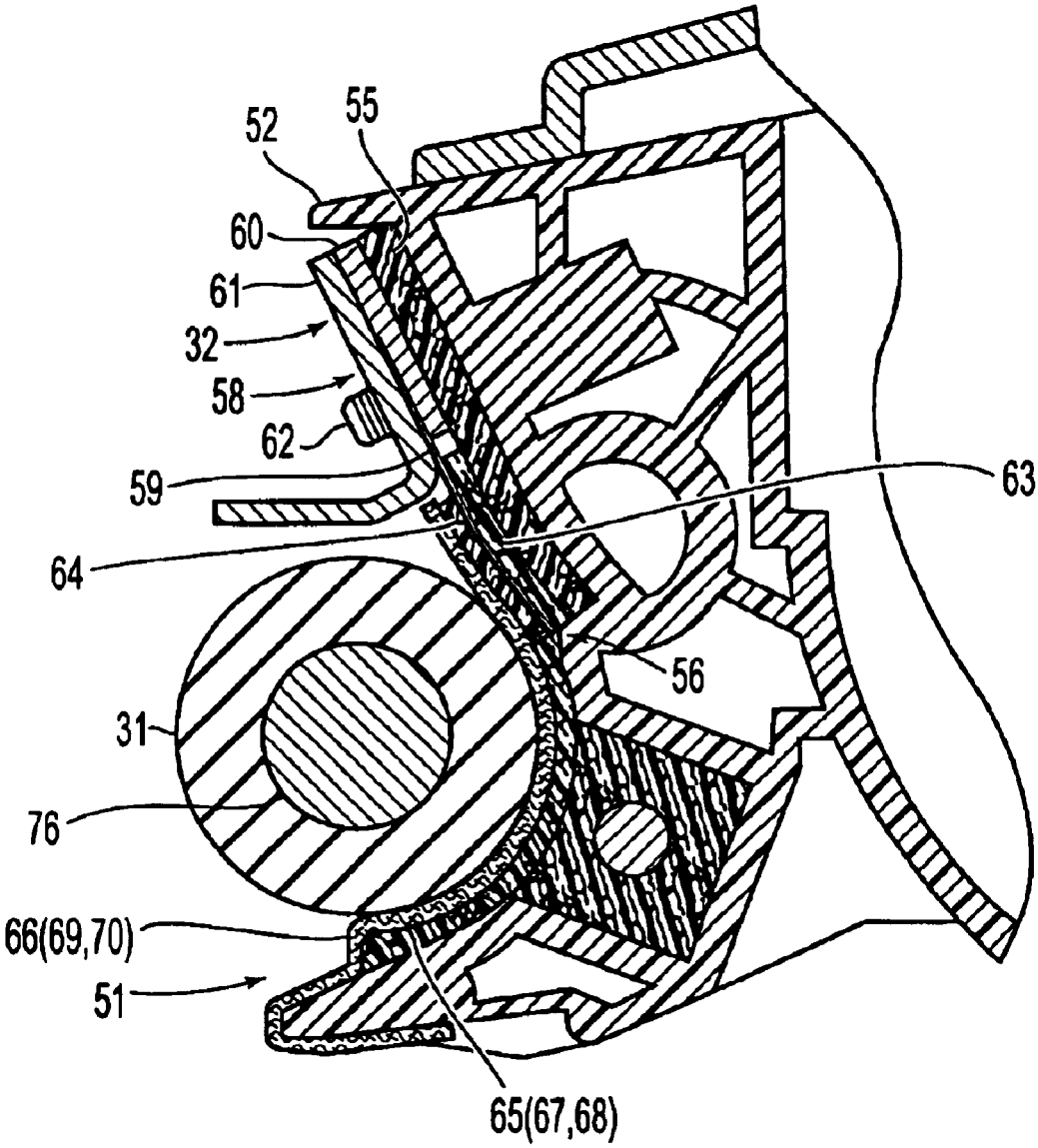
FIG. 6 is a side sectional view of the substantial parts of the sealing structure at the end of the developing cartridge shown in FIG. 4B, when the developing roller is mounted.

As shown in FIGS. 4A and 6, the end of the housing 52 where the side seal 51 is provided is formed in a curved shape along the circumferential surface of the developing roller 31, which is roller-shaped, so as to bring the side seal 51 into contact with the developing roller 31. The sponge inner 67 and the sponge outer 68 are affixed along the curved shape.

More specifically, as shown in FIG. 6, upper ends of the sponge inner 67 and the sponge outer 68 are pressed against the back blade seal 63 and the front blade seal 64 constituting the blade side seal 56. As shown in FIG. 4A, a lower end of the sponge inner 67 and the lower side seal 57 slightly overlap each other in the width direction of the housing 52.

The sponge inner 67, the sponge outer 68, the back blade seal 63, and the front blade seal 64 are all made of sponge materials. With this structure, when the upper ends of the sponge inner 67 and the sponge outer 68 are pressed against the back blade seal 63 and the front blade seal 64, sponge materials make contact with each other to reliably prevent toner leakage in their boundaries therebetween.

By making the lower end of the sponge inner 67 and the lower side seal 57 overlap each other, the sponge materials make contact with each other, thereby preventing toner leakage in the boundary between the sponge inner 67 and the lower side seal 57.

The felt sealing element 66 is constituted of a felt inner 69 overlaid on the sponge inner 67, and a felt outer 70 overlaid on the sponge outer 68. Each of the felt inner 69 and the felt outer 70 is of a flexible flat film and made of felt formed by polyester-base fibers.

As shown in FIG. 4B, the felt inner 69 and the felt outer 70 are affixed to the sponge inner 67 and the sponge outer 68, respectively, with double-faced adhesive tape. They extend in a direction perpendicular to the width direction of the housing 52, at the end of housing 52 adjacent to the side wall 53. The felt inner 69 is overlaid on the sponge inner 67, and the felt outer 70 is overlaid on the sponge outer 68.

As the sponge inner 67 and the sponge outer 68 are affixed along the curved shape at the end of the housing 52, the felt inner 69 and the felt outer 70 are also overlaid on the sponge inner 67 and the sponge outer 68 along the curved shape.

The surface of the felt inner 69 is an inner sliding contact surface 71 regarded as a first surface where the developing roller 31 slides. The surface of the felt outer 70 is an outer sliding contact surface 72 regarded as a second surface where the developing roller 31 slides. The inner sliding contact surface 71 and the outer sliding contact surface 72 are spaced.

As shown in FIG. 7, an inner member 73 includes the sponge inner 67 and the felt inner 69, and an outer member 74 includes the sponge outer 68 and the felt outer 70. A space S is provided between the inner member 73 and the outer member 74. The space S is of sufficient size to collect toner leaking from the inner sliding contact surface 71 during which toner accommodated in the developing cartridge 28 is used up.

As shown in FIG. 4B, the felt inner 69 and the felt outer 70 are overlaid on the sponge inner 67 and the sponge outer 68 respectively at the end of the housing 52 adjacent to the side wall 53.

As shown in FIGS. 5 and 6, the felt inner 69 and the felt outer 70 cover the front blade seal 64 at the upper ends. They cover the sponge inner 67 and the sponge outer 68 at the lower ends, further extend downwardly from the sponge inner 67 and the sponge outer 68, and roll up the lower end of the housing 52. The felt inner 69 and the felt outer 70 are affixed with double-faced adhesive tape.

As the felt inner 69 and the felt outer 70 cover the front blade seal 64 at the upper ends, toner can be reliably prevented from laterally leaking from the presser portion 40 of the layer thickness-regulating blade 32. As the felt inner 69 and the felt outer 70 move in accordance with the leaf spring member 59 of the layer thickness-regulating blade 32, the movement of the leaf spring member 59 is not limited, and the presser portion 40 is normally pressed against the developing roller 31 under a preferable condition. Thus, a layer of toner formed on the developing roller 31 becomes uniform.

The front blade seal 64 interposed between the felt inner 69, the felt outer 70, and the leaf spring member 59 can be adequately compressed because it is made of a sponge material. The front blade seal 64 effectively absorbs a reactive force of a pressing force between the felt inner 69, the felt outer 70, and the developing roller 31, thereby reliably obtaining the toner sealability between the felt inner 69, the felt outer 70, and the developing roller 31.

The lower film 78 is made of a polyethylene terephthalate (PET) sheet or an urethane rubber film, and affixed, with double-faced adhesive tape, entirely to a top face of the lower part of the housing 52, as shown in FIGS. 2 and 3. The lower film 78 prevents toner from leaking from the lower part of the housing 52.

Figure 8:
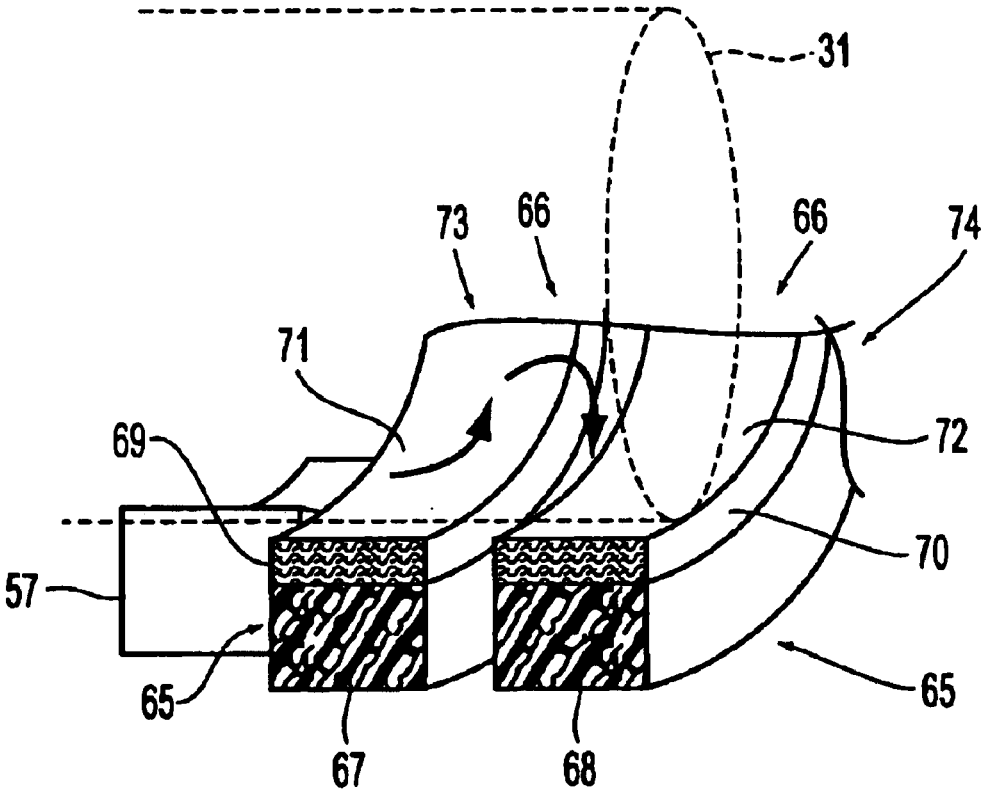
FIG. 8 illustrates a structure of the side seal shown in FIG. 4B to prevent toner leakage.

The developing roller 31 is rotatably mounted in the housing 52 by inserting the roller shaft 76 of the developing roller 31 along and into the support hole 54 from the front face where the housing 52 is open, as shown in FIG. 4B. Thus, the developing roller 31 can rotated in a state that the circumferential surface of the developing roller 31 makes sliding contact with the inner sliding contact surface 71 and the outer sliding contact surface 72 at the end, as shown in FIGS. 6 and 8.

Thus, while the developing roller 31 rotates, toner leakage can be prevented from between the developing roller 31, the inner sliding contact surface 71, and the outer sliding contact surface 72 at the end of the developing roller 31.

Toner not adhered on the photosensitive drum 27 but remaining on the developing roller 31 is ground by the lower side seal 57 during the rotation of the developing roller 31. Toner is diffused outward with respect to the axial direction of the developing roller 31 as indicated by arrows of FIG. 8. Toner gradually passes in between the developing roller 31 and the inner sliding contact surface 71 of the felt inner 69.

While the laser printer 1 is used under high speed printing or over an extended period of time, toner accumulates entirely on the inner sliding contact surface 71, so that toner may leak outside of the inner sliding contact surface 71.

In the side seal 51, the toner leaked outside the inner sliding contact surface 71 drops in the space S between the inner member 73 and the outer member 74. Thus, toner does not pass in between the developing roller 31 and the outer sliding contact surface 72, thereby preventing toner leakage outside the developing cartridge 28.

The side seals 51 having the above-described structure are provided on both ends of the housing 52, with respect to the axial direction of the developing roller 31 when mounted in the housing 52 in position. In each side seal 51, the inner sliding contact surface 71 and the outer sliding contact surface 72 are pressed against and rubbed by the circumferential surface of the developing roller 31, thereby reliably preventing toner from leaking from both ends of the housing 51 with respect to the axial direction of the developing roller 31.

In the laser printer 1 according to the embodiment, a polymerized toner is used. The polymerized toner is easy to pass in between the developing roller 31 and the side seal 51 by the rotation of the developing roller 31 because it is excellent in flowability.

In this embodiment, toner carried on the inner sliding contact surface 71 drops in the space S, but does not leak outside beyond the outer sliding contact surface 72. With this structure, high quality images can be obtained through the use of the polymerized toner without concern for toner leakage.

In the laser printer 1 according to the embodiment, an impression developing method which uses a nonmagnetic single-component toner to make contact with the developing roller 31 and the photosensitive drum 27, is adopted. The developing roller 31 is made of an elastic member so as to obtain high quality images by reducing damage to toner and the photosensitive drum 27.

The developing roller 31 made of the elastic member is apt to cause toner leakage, as compared with that made of a foam material. If the developing roller 31 is made of metal, it is also apt to cause toner leakage because the surface becomes easily scratched. These problems appear obviously as the use of the laser printer 1 prolongs.

If toner is fed on the inner sliding contact surface 71, it may not leak outside beyond the outer sliding contact surface 72 although it drops in the space S. Thus, high quality images can be obtained through the use of the developing roller 31 made of an elastic member, without any problem.

The felt inner 69 and the felt outer 70 are made of felt formed by polyester-base fibers.

The following are descriptions about actions and effects when a polyester-base felt is used for the felt inner 69 and the felt outer 70.

It is preferable that the polyester-base felt is made of 100% polyester fibers. However, the polyester-base felt may be a blend of other fibers as long as polyester is mainly used.

If a Teflon® felt is used for a sealing element, it has an effect of reducing torque of the developing roller 31 because the Teflon® fiber is thick as compared with polyester fiber. However, the Teflon® felt is liable to sustain damage due to friction with the developing roller 31.

Because the Teflon® felt is weak and tends to be torn, toner can pass in between the developing roller 31 and the sealing element, and consequently, toner leakage is prone to occur. If the developing roller 31 is rotated at a high speed during continuous use of the laser printer 1, a problem that the Teflon® felt tends to be torn comes to the surface conspicuously.

In this embodiment, as the polyester-base felt is used for the felt inner 69 and the felt outer 70, improvements in wear resistance and durability can be obtained as compared with the Teflon® felt. Even if the developing roller 31 is rotated at a high speed during continuous use of the laser printer 1, preferable toner sealability can be ensured.

The polyester-base felt of the embodiment is made up of at least two different kinds of fibers in thickness, a fine fiber and a thick fiber, and preferably, the fine fiber constitutes more than 30% of the total fibers. It is further preferable that the fine fiber constitutes more than 50% of the total fibers. It is desirable that the fine fiber has a thickness smaller than or equal to 2.1 times as large as the mean diameter of toner particle and is made of 100% polyester.

In this way, as the fine fiber and the thick fiber are tangled into the polyester-base felt, the fine fiber can prevent toner leakage and damage such as wear during continuous use, and the thick fiber can prevent reduction of the strength due to abrasion caused by the developing roller 31 during continuous use.

When the fine fiber makes up 30% or more of the total fibers, toner leakage and damage such as wear can be reliably prevented.

When the thickness of the fine fiber is smaller than or equal to 2.1 times of the mean diameter of toner particle, the flow of toner can be effectively inhibited with the fine fiber structure, so that toner leakage can be reliably prevented from occurring. When the fine fiber is made of 100% polyester, the wear resistance and the durability can be improved. With the use of the felt inner 69 and the felt outer 70 satisfying the above requirements, preferable toner sealability can be obtained.

More specifically, the inner felt 69 and the outer felt 70 used in the laser printer 1 each include fine fiber of 100% polyester having a thickness of approximately 12.5 μm, and thick fiber of 100% polyester having a thickness of approximately 25–26 μm, fifty-fifty. With this combination, toner of which the mean particle size is up to 6 μm can be sealed.

In the embodiment, the felt inner 69 and the felt outer 70 are made of the above-described polyester-base felt.

If a sealing element is made of a foam member such as a sponge material, it gets damaged and torn due to abrasion caused by the developing roller 31. If a sealing element is made of an elastic member such as rubber, frictional resistance between the developing roller 31 and the sealing element becomes great, great loads are imposed on the developing roller 31 and the sealing element, and torque of the developing roller 31 needs increasing. If toner flows between the developing roller 31 and the sealing element, the toner scratches the surface of the sealing element from which toner is prone to leak.

However, as the felt inner 69 and the felt outer 70 are formed into felt, the frictional resistance between the developing roller 31, the felt inner 69 and the felt outer 70 can be decreased, and toner leakage can be prevented.

A lubricating agent is applied to the inner and outer sliding contact surfaces 71, 72 of the felt inner 69 and the felt outer 70. While the developing roller 31 rotates, the lubricating agent works between the developing roller 31, the felt inner 69 and the felt outer 70, to reduce the frictional resistance. Thus, the application of the lubricating agent can decrease torque of the developing roller 31, and improve the wear resistance and the durability. Further, the application of the lubricating agent can prevent noise due to the sliding contact between the developing roller 31, the felt inner 69 and the felt outer 70 from generating.

More specifically, the inner sliding contact surface 71 and the outer sliding contact surface 72 are coated with a fluorine-base lubricating agent in which a fluorine oil and fluorine-base resin are dissolved into a volatile solvent.

When the fluorine-base lubricating agent is applied to the inner sliding contact surface 71 and the outer sliding contact surface 72, the fluorine oil and the fluorine-base resin lower the friction. Thereby, the frictional resistance between the developing roller 31, the felt inner 69, and the felt outer 70 is further decreased, and the wear resistance and the durability are further improved. In addition, the noise due to the sliding contact between the developing roller 31, the felt inner 69, and the felt outer 70 is also prevented from generating.

The method to apply the fluorine-base lubricating agent to the inner sliding contact surface 71 and the outer sliding contact surface 72 is not particularly limited. For example, the lubricating agent may be previously applied with a brush to the surface of the long length of felt from which the felt inner 69 and the felt outer 70 are to be cut to a defined size. The amount of the application of the fluorine-base lubricating agent can be changed as needed. For example, approximately 25±5 g of the lubricating agent is used for 100 felt inners 69 or felt outers 70. The lubricating agent above is detailed in U.S. patent application Ser. No. 09/641,919, the disclosure of which is incorporated by reference in its entity.

As the fluorine-base lubricating agent, a fluorine-base lubricating agent manufactured by Kanto Kasei Co., Ltd. and known under the trademark of Hanarl FL-Z75 is used in this embodiment. Hanarl FL-Z75 contains 80–90 wt % hydrofluorocarbon, as a volatile solvent, and 10–20 wt % polytetrafluoroethylene (PTFE) and other components, as a fluorine oil and a fluorine-base resin.

Another lubricating agent under the trademark of Hanarl FL-955 manufactured by Kanto Kasei Co., Ltd. may be used. Hanarl FL-955 contains 85–95 wt % perfluoroalkane, as a volatile solvent, and 5–15 wt % polytetrafluoroethylene (PTFE) and other components, as a fluorine oil and a fluorine-base resin.

In the laser printer 1 according to the embodiment, a polymerized toner with excellent fluidity is used. The polymerized toner is likely to pass in between the developing roller 31 and the side seal 51 when the developing roller 31 rotates because of its excellent fluidity.

In this embodiment, the felt inner 69 and the felt outer 70 for the side seal 51 are made of the polyester-base felt, as described above. As toner that passed in between the developing roller 31 and the side seal 51 is reliably absorbed by the felt inner 69 and the felt outer 70, toner can be reliably prevented from leaking from the developing cartridge 28.

The laser printer 1 is provided with the developing cartridge 28 that reliably seals toner leakage as described above. Thus, toner can be prevented from spattering inside the casing 2. Thus, the operation of the laser printer 1 can be ensured, and the preferable toner sealability can be obtained even if the developing roller 31 is rotated at a high speed to increase an image forming speed.

When toner drops from the inner sliding contact surface 71 in the space S, it becomes oily because of the fluorine-base lubricating oil applied to the inner sliding contact surface 71. Thus, toner becoming oily adheres to a side surface or a bottom surface within the space S, and does not move toward a lower open end between the inner member 73 and the outer member 74.

To prevent toner leakage, a toner stopper may be provided at the lower open end between the inner member 73 and the outer member 74.

Figure 9:
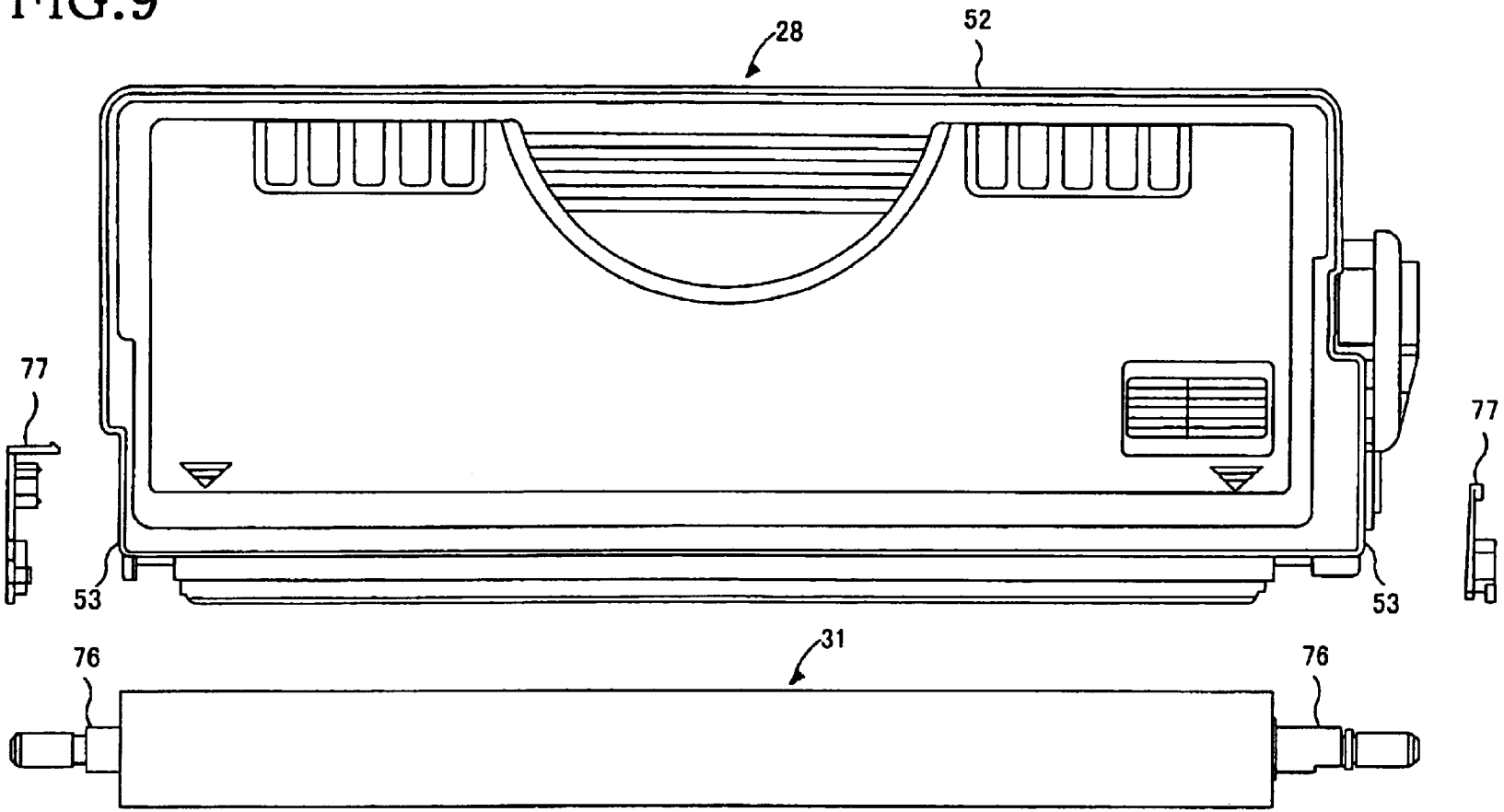
FIG. 9 is a plan view of the developing cartridge before the developing roller is mounted.
Figure 10:
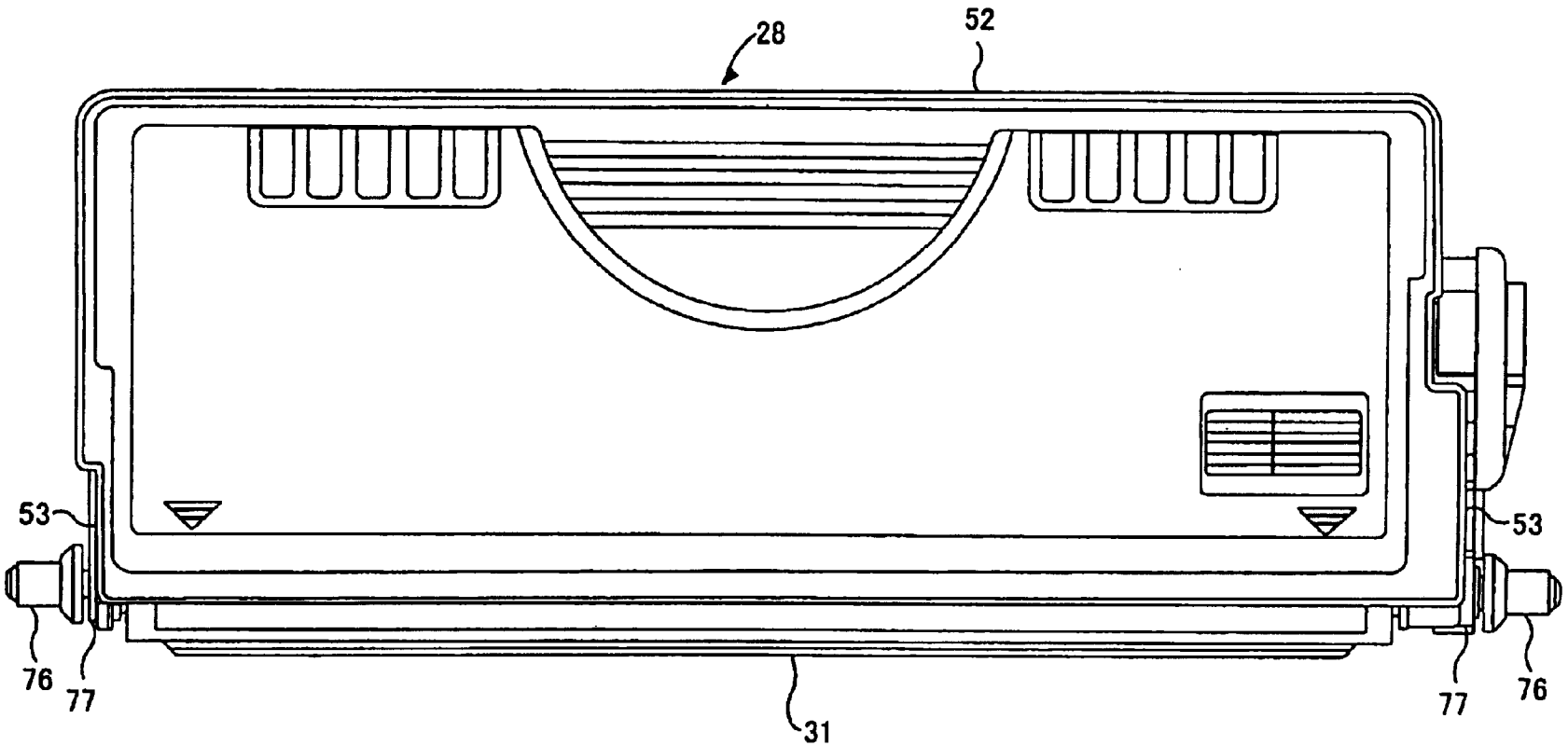
FIG. 10 is a plan view of the developing cartridge after the developing roller is mounted.

Referring to FIGS. 9 and 10, a method to mount the developing roller 31 in the developing cartridge 29 will be described.

The side seals 51 each including the inner member 73 and the outer member 74 are placed on both ends of the housing 52 of the developing cartridge 28, as shown in FIG. 9. The developing roller 31 is oriented, in front of the developing cartridge 28, so that the width direction of the housing 52 is in face-to-face relation with the axial direction of the developing roller 31, and moved toward the housing 52, in a direction substantially perpendicular to the width of the housing 52. The roller shaft 76 of the developing roller 31 is inserted into the support holes 54 of the side walls 53 on both sides of the housing 52, so that the developing roller 31 is located on the side seals 51.

Bearings 77 are attached to both ends of the roller shaft 76 of the developing roller 31 from outside both side walls 53 of the housing 52, so that, as shown in FIG. 10, the developing roller 31 is mounted in the developing cartridge 28.

If the developing roller 31 is inserted in the housing 52 from the width direction of the housing 52, the inner sliding contact surface 71 and the outer sliding contact surface 72 of each of the side seals 51 are rubbed along the axial direction of the developing roller 31 due to sliding contact with the circumferential surface of the developing roller 31. By friction due to the sliding contact, the inner member 73 and the outer member 74 are deformed toward the axial direction of the developing roller 31.

However, in this embodiment, the developing roller 31 is placed on the side seals 51 from the direction perpendicular to the width of the housing 52. In other words, the developing roller 31 is inserted in a direction of the long side of each of the side seals 51.

Thus, the inner member 73 and the outer member 74 are not rubbed in the axial direction of the developing roller 31 although they receive a pressing force of the developing roller 31 from the direction of the long side of the inner member 73 and the outer member 74. Thus, the side seals 51 are not deformed in the axial direction of the developing roller 31. In this way, the developing roller 31 can be mounted in the housing 52 such that toner should not leak.

Each of the side seals 51 is made up of the two parts, the inner member 73 and the outer member 74. To avoid increasing the size of the developing cartridge 28, the inner member 73 and the outer member 74 should be formed as narrow as possible. If the inner member 73 and the outer member 74 are made narrow, they are weak in rigidity, and liable to deform by a force from the width direction of the housing 52. If the developing roller 31 is mounted from the width direction of the housing 52, the inner member 73 and the outer member 74 should have rigidity as to the width direction. To provide greater rigidity in the inner member 73 and the outer member 74, widening and material change may be required. As a result, the cost of manufacturing will be increased.

However, when the developing roller 31 is mounted as in this embodiment, the inner member 73 and the outer member 74 does not need increase in the rigidity, and the developing roller 31 can be easily mounted so that toner should not leak.

In the above embodiment, each of the side seals 51 is made up of the inner member 73 including the sponge inner 67 and the felt inner 69, and the outer member 74 including the sponge outer 68 and the felt outer 74.

As long as the space S, where the developing roller 31 and the side seal 51 do not make contact with each other, is provided between the inner sliding contact surface 71 and the outer sliding contact surface 72, the side seal 51 is not limited to the above-described structure because an equivalent effect can be obtained.

Figure 11:
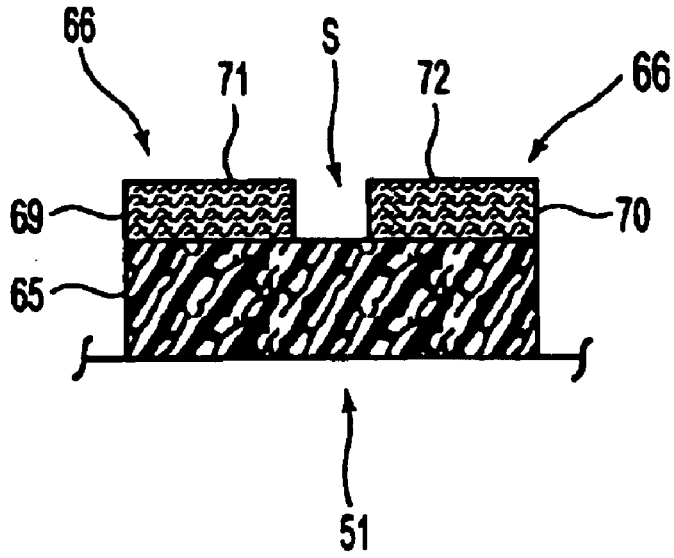
FIG. 11 is a sectional view of substantial parts of a side seal modified from that shown in FIG. 7.

As shown in FIG. 11, the side seal 51 may be designed in such a manner to place the felt inner 69 and the felt outer 70 on one sponge seal 65, which is rectangular in a sectional view, at a specified distance from each other, to provide the space S where the developing roller 31 and the side seal 51 do not make contact with each other.

Figure 12:
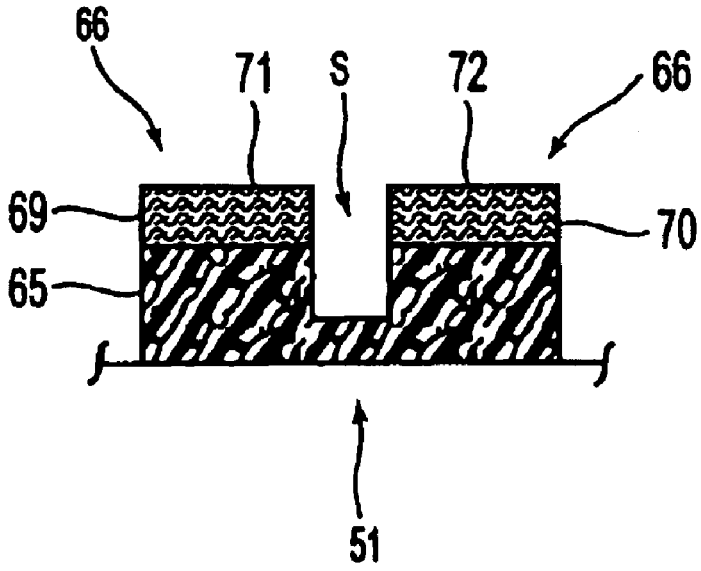
FIG. 12 is a sectional view of substantial parts of a side seal modified from that shown in FIG. 7.

As shown in FIG. 12, the side seal 51 may be designed in such a manner to place the felt inner 69 and the felt outer 70 on one sponge seal 65, which is of C-shape in a sectional view, at a specified distance from each other, to provide the space S where the developing roller 31 and the side seal 51 do not make contact with each other.

The inner member 73 and the outer member 74 are made of substantially the same width. However, to stabilize the rotation of the developing roller 31, the outer member 74 may be formed so as to be wider than the inner member 73.

The side seal 51 is made up of the inner member 73 and the outer member 74. However, one or more parts may be interposed between the inner member 73 and the outer member 74, to provide the same structure as the inner member 73 and the outer member 74.

The inner member 73 and the outer member 74 may not be provided with the sponge inner 67 and the sponge outer 68 according to the purpose and application. In other words, the inner member 73 and the outer member 74 may be made up of only the felt inner 69 and the felt outer 70.

The side seal 51 having the inner member 73 and the outer member 74 is provided at each end of the housing 52 with respect to the axial direction of the developing roller 31 when mounted in the housing 52. Instead, the side seal 51 may be provided at only one end of the housing 52 where toner is further prone to leak. At the other end, a side seal where a felt sealing element 66 is overlaid on the sponge seal 65 may be used.

The inner sliding contact surface 71 and the outer sliding contact surface 72 are disposed so as to make sliding contact with the circumferential surface of the developing roller 31. Instead, the inner sliding contact surface 71 may be disposed to make sliding contact with the circumferential surface of the developing roller 31, and the outer sliding contact surface 72 may be disposed to make sliding contact with an end surface of the developing roller 31.

The side seal 51 is used to prevent toner from leaking from both ends of the developing roller 31 when mounted in the housing 52 in position. Instead, the side seal 51 may be placed at an end of a rotated element having a bearing, such as the supply roller 33 and the agitator 36.

The felt sealing element 66 is made of felt from polyester-base fibers. However, it may be a knit fabric, hair implant, nonwoven material, and other media as long as it is made of polyester-base fibers.

What is claimed is:

1. A developing agent container, comprising:

a housing that accommodates developing agent;

a feeding element that is rotatable and that feeds the developing agent from the housing; and a sealing element provided at an end of an inside of the housing with respect to an axial direction of the feeding element when mounted in the housing in position, the sealing element having a downstream portion that is positioned at a downstream edge of the sealing element in a rotative direction of the feeding element, wherein the sealing element prevents the developing agent from leaking out of the housing, and the sealing element comprises a first surface and a second surface at the downstream portion, both of which contact a surface of the feeding element, and a space is provided between the first surface and the second surface at the downstream portion so that the second surface is positioned away from the first surface.

2. The developing agent container according to claim 1, wherein the first surface and the second surface are disposed astride the space in a direction perpendicular to a direction that the developing agent is fed.

3. The developing agent container according to claim 1, wherein the feeding element is roller-shaped and has a circumferential surface that makes sliding contact with the first surface and the second surface.

4. The developing agent container according to claim 3, wherein the sealing element is disposed in face-to-face relation with an end of the feeding element with respect the axial direction thereof.

5. The developing agent container according to claim 1, wherein the sealing element is made of felt.

6. The developing agent container according to claim 5, wherein the felt is formed by polyester-base fibers.

7. The developing agent container according to claim 6, wherein the polyester-base fibers have a thickness of which is not greater than 2.1 times as large as a mean particle diameter of the developing agent.

8. The developing agent container according to claim 1, wherein the first surface and the second surface are coated with a fluorine-base lubricating agent including a fluorine oil and a fluorine-base resin.

9. The developing agent container according to claim 1, wherein the developing agent is prepared by polymerization.

10. A method for assembling the developing agent container according to claim 1, the method comprising the steps of:

placing the sealing element in the housing;

placing the feeding element on the first surface and the second surface from a direction parallel to a direction that the feeding element feeds the developing agent; and placing a bearing at the end of the feeding element from outside the housing.

11. The developing agent container according to claim 1, wherein the sealing element comprises:

a first sealing element; and a second sealing element separated from the first sealing element so that the space is provided between the first sealing element and the second sealing element.

12. The developing agent container according to claim 11, wherein the first sealing element comprises:

a first base element;

a first sealing material provided on the first base element;

a second base element; and a second sealing material provided on the second base element.

13. The developing agent container according to claim 12, wherein the first base element and the second base element are made of sponge, and the first sealing material and the second sealing material are made of felt.

14. The developing agent container according to claim 1, wherein the sealing element comprises:

a single base element; and a sealing material provided on the single base element, the first surface and the second surface being formed of the sealing material.

15. The developing agent container according to claim 14, wherein the sealing material comprises:

a first sealing material; and a second sealing material separated from the first sealing material, both the first sealing material and the second sealing material being provided on the single base element at a distance from each other.

16. The developing agent container according to claim 15, wherein the single base element is formed of C-shape in a sectional view to have a first branch and a second branch at a distance from each other, the first sealing material being provided on the first branch and the second sealing material being provided on the second branch.

* * * * *